US005826511A

United States Patent [19]

Schmitt

[11] Patent Number: 5,826,511

[45] Date of Patent: Oct. 27, 1998

[54] DEVICE FOR CLEANING DIRECTLY IMAGED PRINTING FORMS IN A PRINTING PRESS

[75] Inventor: Dieter Schmitt, Sandhausen, Germany

[73] Assignee: Heidelberger Druckmaschinen AG, Heidelberg, Germany

[21] Appl. No.: 782,096

[22] Filed: Jan. 13, 1997

[30] Foreign Application Priority Data

Jan. 12, 1996 [DE] Germany ..... 196 00 844.1

[51] Int. Cl.[6] ..... B41F 35/00

[52] U.S. Cl. ..... 101/425; 101/423

[58] Field of Search ..... 101/425, 423, 101/424; 15/256.5, 256.51, 256.52, 104.002

[56] References Cited

U.S. PATENT DOCUMENTS

| | | | |
|---|---|---|---|
| 2,518,384 | 8/1950 | Settergren | 15/208 |
| 2,752,271 | 6/1956 | Walkup et al. | 101/425 |
| 3,411,444 | 11/1968 | Boneschi | 101/425 |
| 3,735,702 | 5/1973 | Kossak | 101/425 |
| 5,086,701 | 2/1992 | Gasparrini et al. | 101/425 |
| 5,207,160 | 5/1993 | Harada | 101/425 |
| 5,255,606 | 10/1993 | Iijima et al. | 101/425 |
| 5,300,248 | 4/1994 | Passler et al. | 15/208 |
| 5,346,753 | 9/1994 | Ostrower | 15/208 |
| 5,605,749 | 2/1997 | Pike et al. | 15/209.1 |

FOREIGN PATENT DOCUMENTS

| | | |
|---|---|---|
| 0 523 584 B1 | 1/1993 | European Pat. Off. . |
| 30 07 611 C2 | 9/1990 | Germany . |
| 41 23 959 C1 | 2/1993 | Germany . |
| 42 16 636 A1 | 11/1993 | Germany . |
| 44 26 012 A1 | 1/1996 | Germany . |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

A device for cleaning silicone particles and other residues from directly imaged printing forms of a printing form cylinder in a printing press includes a cleaning element extending parallel to the axis of the printing form cylinder and movable substantially radially against the printing form cylinder, the cleaning element having a cleaning surface with which it is engageable with the printing form, the cleaning surface being formed with a fleece of fine microfibers of plastic material.

8 Claims, 1 Drawing Sheet

DEVICE FOR CLEANING DIRECTLY IMAGED PRINTING FORMS IN A PRINTING PRESS

BACKGROUND OF THE INVENTION

FIELD OF THE INVENTION

The invention relates to a device for cleaning silicone particles and other residues from directly imaged printing forms of a printing form cylinder in a printing press.

Conventional cleaning devices in printing presses are often formed of a cleaning cloth which is unwindable from a supply roll and wound onto a take-up spool and, in the course of which, is guided over a pressing element by which the cleaning cloth can be brought into contact with the outer cylindrical surface of the printing form cylinder or, optionally, a rubber blanket cylinder or an impression cylinder, as well. Such cleaning devices have become known heretofore, for example, from the German Democratic Republic Patent DD 203 501, the published and prosecuted German Patent Application DE-AS 25 38 05, and the published and prosecuted European Patent Application EP 0 590 195 A1. The prerequisite for the effectiveness of such washing devices depends is that a washing liquid, preferably an alcoholic washing solution, be supplied.

In direct imaging of printing forms by laser, silicone particles are detached or released which must be eliminated from the printing form without residue before printing, yet without producing scratches on the printing form, if a good printed product is to be achieved. Moreover, assurance must be provided that no detached silicon particles or other contaminants find their way into the inking unit. The washing devices of the prior art have not yet provided satisfactory results for this particular application. Cleaning methods developed especially for this type of application are effective only with solvents which are considered to be very critical from a safety standpoint and objectionable from an environmental standpoint.

Cleaning devices of the type developed especially for directly imaged printing plates and offered recently by manufacturers have not produced any decisive improvement. Even those cleaning devices leave scratches behind on the printing plate, and cannot prevent burnoff from the plates from getting into the inking unit.

SUMMARY OF THE INVENTION

It is accordingly an object of the invention to provide a device for cleaning directly imaged printing forms, more particularly, laser-imaged printing plates, effectively without any addition of chemicals, which leaves no scratches behind on the printing plates, and avoids any contamination of the inking unit from burnoff or the like.

With the foregoing and other objects in view, there is provided, in accordance with the invention, a device for cleaning silicone particles and other residues from directly imaged printing forms of a printing form cylinder in a printing press, comprising a cleaning element extending parallel to the axis of the printing form cylinder and movable substantially radially against the printing form cylinder, the cleaning element having a cleaning surface with which it is engageable with the printing form, the cleaning surface being formed with a fleece of fine microfibers of plastic material.

In accordance with another feature of the invention, the cleaning surface is formed by a wiping cloth of microfine fibers of plastic material useable by itself for household cleaning purposes.

In accordance with a further feature of the invention, the cleaning element extends in a rodlike form over approximately the width of the printing form, and is movable in axial direction of the printing form cylinder.

In accordance with an added feature of the invention, the cleaning element is formed of a journalled roller having a jacket made of a soft fleece formed of microfibers of plastic material.

In accordance with an additional feature of the invention, the cleaning element is combined with a suction device for vacuuming the microfiber fleece, which is engaged with the printing form, for removing from the fleece particles which have come loose from the printing form.

In accordance with yet another feature of the invention, the suction device is disposed behind the cleaning element, as viewed in the direction of rotation of the printing form cylinder.

In accordance with yet a further feature of the invention, the suction device is disposed between the cleaning element and a roller having an adhesive jacket face positionable with the circumference thereof against the printing form of the printing form cylinder.

In accordance with a concomitant feature of the invention, the cleaning device includes a washing device disposed adjacent to the soft fleece of microfibers formed of plastic material for moistening the fleece.

In a nonwoven microfiber fleece suitable for cleaning a directly imaged printing form, fine microfibers of plastic material are spread out in a fibrous web and are available on the market in that form. Such fleeces have already come into use as household cleaning cloths.

With this cleaning element of a soft microfiber fleece of plastic material, detached silicone particles are rubbed away from the printing plate, which prevents these silicone particles from getting into the printing unit. The soft fleece effectively prevents damage to the printing plates.

An improvement in effectiveness can be attained by providing that the cleaning element, with the soft microfiber fleece resting on the printing form, is arranged so that it moves revolvingly or reciprocatingly, i.e., chatoyant, in the axial direction of the printing form cylinder.

Experiments have shown that an improvement in effectiveness is also attained by moistening the soft microfiber fleece resting on the printing plate.

In a structural embodiment of the invention, the cleaning element, for example,is formed of a strip which extends transversely over the sheet width, and has a microfiber fleece secured thereto which can be positioned against the circumference or outer cylindrical surface of the printing form cylinder.

Instead of such a strip as a stable carrier or support, a cleaning element formed of a rotatably supported roller with a jacket of a soft fleece formed of plastic material may also be used.

In a further structural embodiment of the invention, the cleaning element is combined with a suction device for vacuuming away detached or disengaged particles, this suction device being disposed behind the cleaning element, as viewed in the direction of rotation of the printing form cylinder. Moreover, an improvement is attained in that the suction device for vacuuming away loosened particles is disposed between the cleaning element and a roller having an adhesive jacket face, the roller being positionable with the outer cylindrical surface or circumference thereof against the printing form of the printing form cylinder, so that this adhesive roller binds any vagabond particles which are present and prevents these particles from getting into the inking unit.

Moistening of the fleece formed of plastic material produces an improvement in effectiveness, as tests have shown.

Compared with conventional devices, an advantage is attained with the cleaning device according to the invention, in that the effectiveness of the cleaning device requires no alcohol and no other chemicals. Thus, a requirement for a supply container for such cleaning fluids is thereby also avoided. No hose connections or valves for supplying the cleaning solution are needed. Consequently, there is neither a safety risk nor any environmental pollution from cleaning solutions, either.

The relatively simple construction of the cleaning device according to the invention allows for relatively economical manufacture and easy, time-saving assembly.

Other features which are considered as characteristic for the invention are set forth in the appended claims.

Although the invention is illustrated and described herein as embodied in a device for cleaning directly imaged printing forms in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, wherein:

DESCRIPTION OF THE PREFERRED EMBODIMENTS

Figure 1:
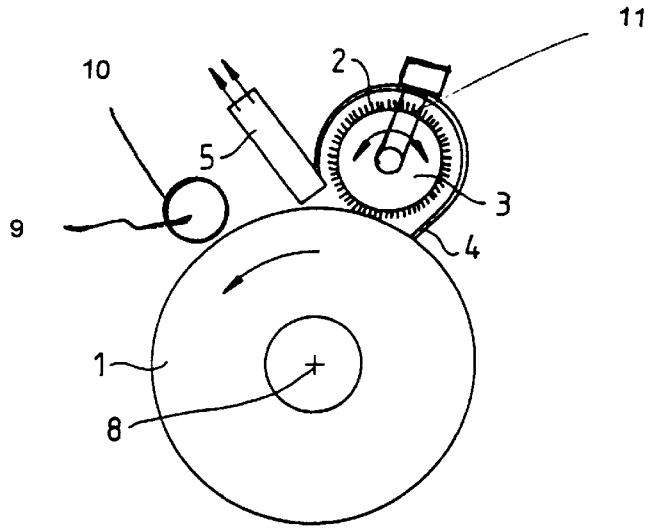
FIG. 1 is a diagrammatic side elevational view of a printing form cylinder with a first embodiment of a cleaning device constructed in accordance with the invention.

Referring now to the drawing and, first, particularly to FIG. 1 thereof, there is shown therein a cloth or fleece 2 formed of fine microfibers of plastic material for cleaning laser-imaged printing forms, which are disposed on the circumference of a printing form cylinder 1. Such a fleece formed of plastic material is available in the marketplace and is offered as a household cleaning cloth. A fibrous web of fine microfibers is spread out thereon. In the embodiment of FIG. 1, such a plastic fleece is formed as a tubular sheath for a roller 3, forming the jacket face of this roller. The roller 3 is disposed so as to be movable by the moving device 11, radially to the rotary axis 8 of the printing form cylinder 1, so that the roller with the plastic fleece 2 forming the jacket face thereof can be positioned against the printing forms on the outer cylindrical surface or circumference of the printing form cylinder 1 and retracted to a rest position again. For the cleaning operation, the roller 3 is rotatingly drivable counter to the direction of rotation of the printing form cylinder 1. The roller 3 with the plastic fleece 2 forming the jacket face thereof is preferably disposed in a housing which, on the one hand, is largely sealed off from the outer cylindrical surface or circumference of the printing form cylinder 1 by a sealing lip 4 and, on the other hand, is joined to the housing of a suction or vacuuming device 5 disposed behind the roller 3 as viewed in the rotary direction of the printing form cylinder 1. With the aid of the suction or vacuuming device 5, silicone particles which have come loose from the printing form and other vagabond contaminants are removed by suction to prevent them from being deposited in the inking unit of the printing press. The tubular sheath of the microfiber plastic fleece 2 is preferably replaceable. An oscillating movement of the roller 3 may optionally improve the cleaning action. An improvement in cleaning action can also be attained by moistening the plastic fleece 2 on the outer cylindrical surface or circumference of the roller 3. Suitable conventional moisteners for moistening the plastic fleece 2 are not shown in the drawing. The moistening may be performed by manual spraying or by a fixedly installed device FIG. 1 also shows a roller 9 having an adhesive jacket 10. The roller 9 is positionable with the outer cylindrical surface or circumference of the printing form of the printing form cylinder 1, so that this adhesive roller 9 binds any loose particles which are present and prevents these particles from getting into an inking unit.

Figure 2:
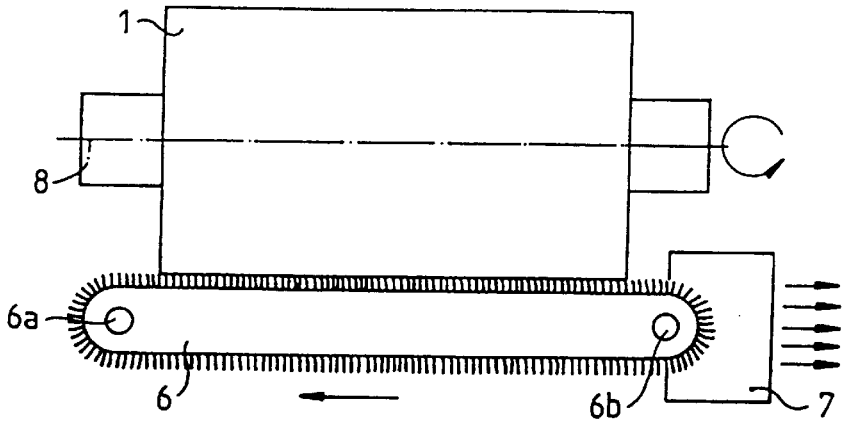
FIG. 2 is a diagrammatic top plan view of a printing form cylinder with a second embodiment of the cleaning device.
Figure 3:
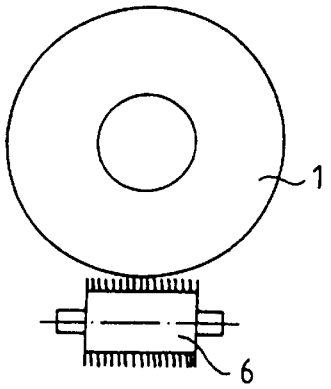
FIG. 3 is a side elevational view of FIG. 2.

In FIGS. 2 and 3, an exemplary embodiment for the structural realization of the features of the invention is shown wherein the fleece 2 formed of plastic material is constructed as a belt 6 disposed at the jacket face of the printing form cylinder 1 and revolving in the axial direction thereof. This belt 6 is likewise movable radially to the axis 8 of the printing form cylinder 1, so that the revolving plastic fleece belt can be positioned radially against the jacket face of the printing form cylinder 1 and retracted to a rest position again. The revolving belt 6 is guided via deflectors or returns 6*a* and 6*b* having bearings in the printing-press frame which are correspondingly movably constructed. Such a cleaning device is also optionally combined with a suction or vacuuming device 5 in accordance with the description of the exemplary embodiment of FIG. 1. In the exemplary embodiment of FIGS. 2 and 3, the possibility arises of providing a cleaning device 7 in the vicinity of a deflector located laterally adjacent the printing form cylinder 1, so that the revolving fleece of plastic material is cleaned continuously.

Soiled fleeces of plastic material can in every case be prepared or made-ready for re-use simply by being washed out, the cleaning device 7 thus being in the form of a washing or spraying device serving this purpose.

I claim:

1. A device for cleaning silicone particles and other residues from directly imaged printing forms of a printing form cylinder in a printing presswithout the use of alcolol or other chemicals, comprising a cleaning element extending parallel to an axis of the printing form cylinder and movable substantially radially against the printing form cylinder, said cleaning element having a cleaning surface with which it is engageable with the printing form, said cleaning surface being formed with a soft nonwoven fleece of fine microfibers of plastic material.

2. The cleaning device according to claim 1, wherein said cleaning surface is formed of a wiping cloth having said microfine fibers of said plastic material.

3. The cleaning device according to claim 1, wherein said cleaning element extends in a rod-shaped form over approximately the width of the printing form, and is movable in axial direction of the printing form cylinder.

4. The cleaning device according to claim 1, wherein said cleaning element is formed of a journalled roller having a jacket made of said soft fleece formed of said microfibers of said plastic material.

5. The cleaning device according to claim 1, wherein said cleaning element is combined with a suction device for vacuuming said microfiber fleece, which is engaged with the printing form, for removing from said fleece particles which have come loose from the printing form.

6. The cleaning device according to claim 5, wherein said suction device is disposed behind said cleaning element, as viewed in a direction of rotation of the printing form cylinder.

7. The cleaning device according to claim 6, including a roller having an adhesive jacket face positionable with a circumference thereof against the printing form of the printing form cylinder and wherein said suction device is disposed between said cleaning element and said roller.

8. The cleaning device according to claim 1, including a washing device disposed adjacent to said soft fleece of said microfibers formed of said plastic material for moistening said fleece.

* * * * *